US005356126A

United States Patent [19]

Bayer et al.

[11] Patent Number: 5,356,126

[45] Date of Patent: Oct. 18, 1994

[54] METHOD AND APPARATUS FOR SEPARATING PILED TEXTILE CUTS

[75] Inventors: Fritz Bayer, Neckartalfingen; Georg Schulz, Neu-Ulm, both of Fed. Rep. of Germany

[73] Assignee: Institu fur Textil - und Verfahrenstechnik der Deutschen Institut fur Textil - und Faserforschung Stuttgart, Kenkendorf, Fed. Rep. of Germany

[21] Appl. No.: 934,635

[22] PCT Filed: Mar. 21, 1991

[86] PCT No.: PCT/EP91/00554

§ 371 Date: Sep. 17, 1992

§ 102(e) Date: Sep. 17, 1992

[87] PCT Pub. No.: WO91/14641

PCT Pub. Date: Oct. 3, 1991

[30] Foreign Application Priority Data

Mar. 21, 1990 [DE] Fed. Rep. of Germany ..... 4009039

[51] Int. Cl.[5] ..... B65H 5/00; B65H 3/22

[52] U.S. Cl. ..... 271/10; 271/18.3; 271/104

[58] Field of Search ..... 271/1, 18, 18.3, 97, 271/98, 104, 167, 169, 10

[56] References Cited

U.S. PATENT DOCUMENTS

| | | | |
|---|---|---|---|
| 3,168,307 | 2/1965 | Walton et al. | 271/97 |
| 3,877,695 | 4/1975 | Carroll | 271/97 X |
| 3,980,293 | 9/1976 | Saelmire | 271/98 X |
| 4,231,563 | 11/1980 | Boucrat | 271/18.3 |
| 4,635,917 | 1/1987 | Granot et al. | 271/18.3 X |
| 4,968,018 | 11/1990 | Hoehne et al. | 271/97 |

FOREIGN PATENT DOCUMENTS

| | | | |
|---|---|---|---|
| 2021233 | 4/1971 | Fed. Rep. of Germany . | |
| 3147818A1 | 9/1982 | Fed. Rep. of Germany . | |
| 3719393A1 | 1/1989 | Fed. Rep. of Germany . | |
| 151266 | 11/1979 | Japan | 271/18.3 |
| 223947 | 8/1992 | Japan . | |

*Primary Examiner*—Robert P. Olszewski
*Assistant Examiner*—Boris Milef
*Attorney, Agent, or Firm*—Lowe, Price, LeBlanc & Becker

[57] ABSTRACT

A method and apparatus for separating an uppermost textile cut from a pile of textile cuts by gripping the uppermost cut at the top surface. The uppermost cut is lifted, and a loader is placed onto a restricted area closed to the edge of the uppermost cut. The uppermost cut is deformed in the restricted area region which causes a relative lateral movement between the uppermost cut and the other cuts. Air is blown through the uppermost cut onto the other cuts, thereby forming a gap between the cuts. A down molder is moved laterally into the gap to completely separate the uppermost cut and the other cuts.

9 Claims, 3 Drawing Sheets

METHOD AND APPARATUS FOR SEPARATING PILED TEXTILE CUTS

DESCRIPTION

Figure 1:
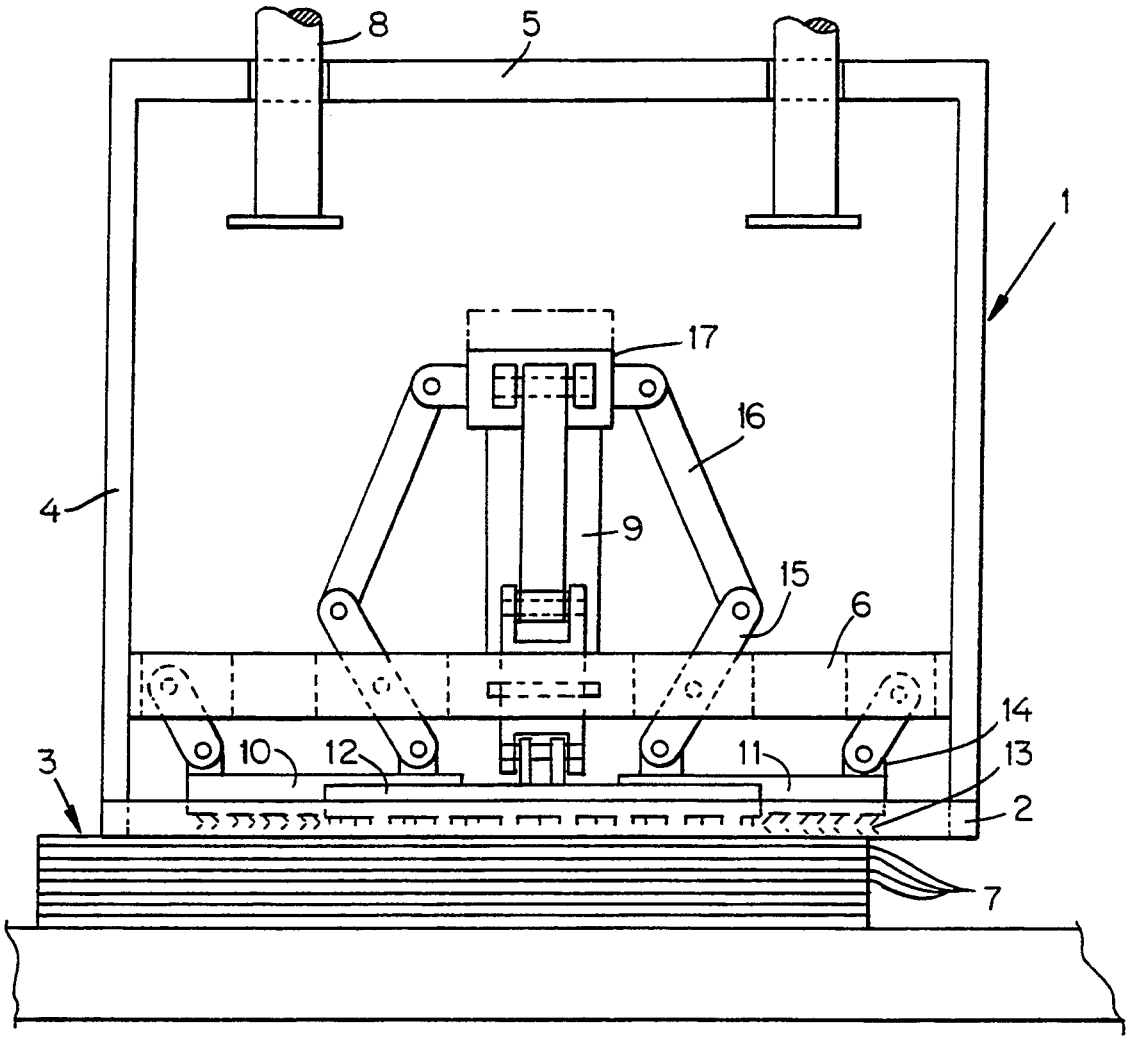

The invention relates to a method for separating piled textile cuts, comprising the precharacterizing features of the patent claim 1 and an apparatus for performing this method.

Such a method and a corresponding apparatus have been disclosed in DE-A-37 19 393 where between the gripping elements air nozzles are arranged for releasing upon gripping of a cut further fabric parts adhering thereto by a corresponding air flow or air pulse. Thereby, the uppermost cut on a cut pile shall be separated by separating from the other adhering fabric parts which cling by fiber hooks to the first gripped cut.

This separating problem constitutes a bottle neck, in particular with the automatization in the clothing industry, since a reliable separating of single cuts from a fabric pile has not been reliably solved. The fabrics are simultaneously cut in a pile in the cutting department according to a predetermined cutting pattern in a plurality of fabric layers such that the pile must be resolved again into its individual cuts for the subsequent processing steps, as sewing, etc. In addition to the fiber hookings there are, in particular, hookings at the cutting edges, caused during cutting, such that between the individual cuts sometimes there are very high, but varying adhesive forces.

According to the DE-A-37 19 393 the excessive cuts shall be blown apart from the current uppermost fabric cut to be gripped. In this connection, the gripping element is preferably formed as a so-called freezing gripper, where the adhering of the uppermost cut is achieved by partially icing the cut. Releasing excessive cuts shall be achieved by air nozzles whose outlet openings are arranged approximately in the plane of the gripping elements. In this connection it may happen, that during activating of the blowing nozzles the upper cut is blown away from the gripping elements since an air cushion is formed between the area-type gripping elements and the gripped fabric layers, which cushion separates the gripped cut(s) partially or completely from the gripper. Even if instead of the freezing gripper adhering grippers or needle grippers having higher gripping forces would be used, this disadvantageous effect is still there, such that no safe separation of the uppermost cut from the residual pile is possible.

In particular when using so-called downholders as a separation assisting means for maintaining this residual pile in order during drawing-up of the uppermost cut from the residual pile, there was the further disadvantage that the uppermost cut loaded by the air flow was pressed down below the engagement level of the downholder such that this cut was gripped by the downholder as well. Therefore, stripping off the uppermost cut was impossible. As a whole, with this apparatus no continuous reproducible separating was achieved. These disadvantages are valid as well for the further known separating apparatuses according to DE-A-20 21 233 and DE-A-31 47 818, since there a downholder was placed onto the cut pile with even an increase of the fiber hookings. The same is true for the separating apparatuses according to U.S. Pat. No. 4,283,047 and U.S. Pat. No. 3,275,317 where during the separating process the central region of the uppermost cut is pressed by a needle or a plate onto the pile and, therefore, the negative fiber hookings are even increased.

Accordingly, it is the object of the invention to provide a method and an apparatus for the separating of piled textile cuts, permitting a reliable separation of further adhering fabric parts from the uppermost cut and, therefore, a safe isolation thereof.

This object is solved by a method comprising the features of patent claim 1, and by an apparatus comprising the features of patent claim 1.

The direct placing of the loading device onto the surface of the gripped cut in a state lifted from the pile results in a sagging downward and, therefore, a warping of the cuts sufficient to produce shearing forces between the uppermost cut to be removed and the excessive cuts, and, therefore, in forming at least a small gap into which the opposite downholder may be moved-in. Such a loosening or gap-forming is particularly increased by pressure exertion by means of an air flow or air pulse, directly through the uppermost textile cut onto the possibly adhering cuts therebelow. Since the uppermost cut directly engages the loading device, in particular a blowing tube, and more or less encloses the latter, the outflowing air is no more able to evade between the gripping element and the surface of the uppermost cut and to separate the latter from the gripping elements. By placing the loading device directly onto the surface of the lifted cut, the latter is warped and sagged downward such that the pores of the fabric are widened resulting in an increased air permeability for the air flow. For this reason, too, an evading or a misguidance of the air flow is essentially excluded. This effect may even be improved by placing the loading device with an additional bias.

In view of the direct air introduction into the uppermost cut a spatially exactly defined gap is formed between the uppermost cut and the possibly adhering second or third cuts, into which gap a downholder for retaining the residual pile may safely be moved, since a type of tunnel is formed by the air cushion between the first and second cuts, into which tunnel the downholder may engage without contact to the cuts. Accordingly, by this method a reliable separation and lifting-off of the uppermost cut are achieved, even if, with thin fabrics overlying the cut pile with a wavy surface, a needle gripper might grip several cuts.

The apparatus for separating piled textile cuts according to the invention has the merits that the loading device, as compared with the known solution, is no more rigidly connected to the gripping elements but is arranged movably in height relative thereto and may be lowered directly onto the surface of the gripped uppermost cut, down below the horizontal plane of the needles or the lower edge of the gripping elements. This movability relative to each other includes in the sense of a kinematic reversion that the loading device is fixedly arranged and that the grippers are movable upward against the loading device together with the gripped cut(s) in order to cause the desired sagging of the cuts in their lifted condition. Even a combination between the movability relative to each other is possible. It is essential in this connection that in the region of the loading device a warping and sagging of the gripped cuts are achieved.

For increasing the above-explained warping of the cuts and the enclosure of the loading device, the loading device in the form of a so-called blowing tube is lowered onto the uppermost cut by biasing a spring element such that constant blowing conditions are achieved. However, in general the own weight of the loading device will be sufficient for a safe placement and, therefore, engagement during the blowing process, in order to prevent a misguidance of the air flow.

As a most simple design the loading device is mounted telescopable within the gripping element such that after gripping the uppermost cut the blowing opening may be lowered below the gripping level (needle level) in order to obtain the abovedescribed warping in the uppermost cut.

Instead of the translatoric movability of the loading device the latter may be mounted at a pivoting bale which, with the preferred design of the blowing tube, simultaneously serves as a pressurized air supply.

It is essential that at any time the same engaging position of the downholder is achieved, in particular in case a stop is provided for the loading device movable in height, such that the gripped upper fabric layer is pressed down below the gripping element by the same amount and the downholder is able to move in in constant distance to the gripping element, between the uppermost cut to be gripped and the excessive fabric parts. On the other hand, by detecting the pivoting angle or, with the translatoric solution, of the lowering-down displacement, the sagging of the uppermost cut may be detected and the engaging level of the downholder may correspondingly be controlled.

Furthermore, detecting the pivoting angle or the lowering-down displacement of the loading device may be used for controlling the engaging force of the loading device on the uppermost cut in order to prevent overloading by the engagement force when changing to different fabric layers.

The common support of the loading device and the downholder, independent from the gripping elements, is of particular importance since by this position relation between the loading device, in particular the lower edge of the blowing tube, and the top side of the downholder may be maintained constant such that after placing the blowing tube simultaneously the moving-in position of the downholder is defined.

Figure 2:
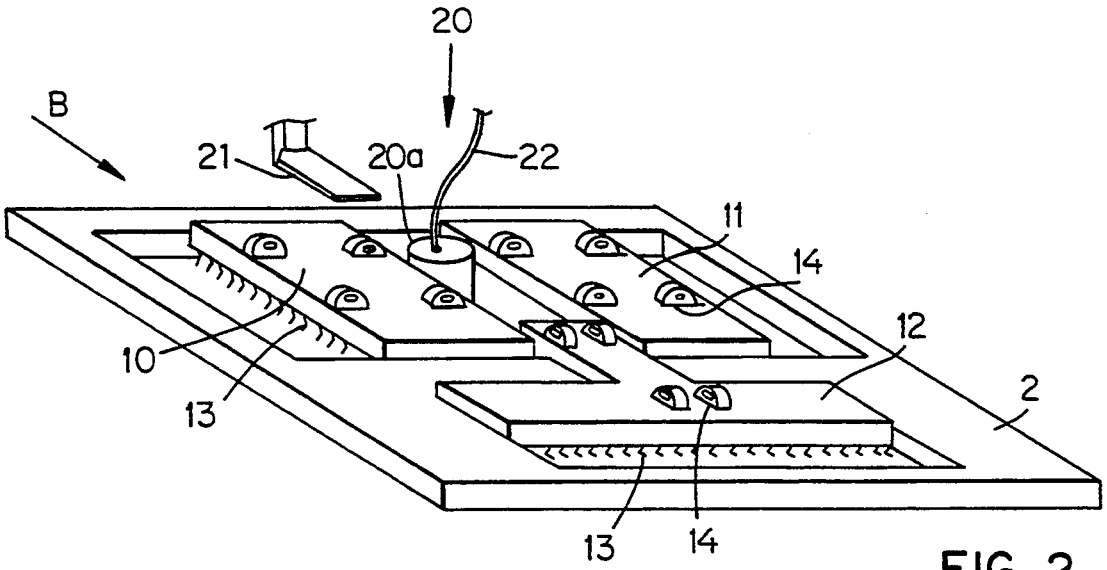
Figure 3:
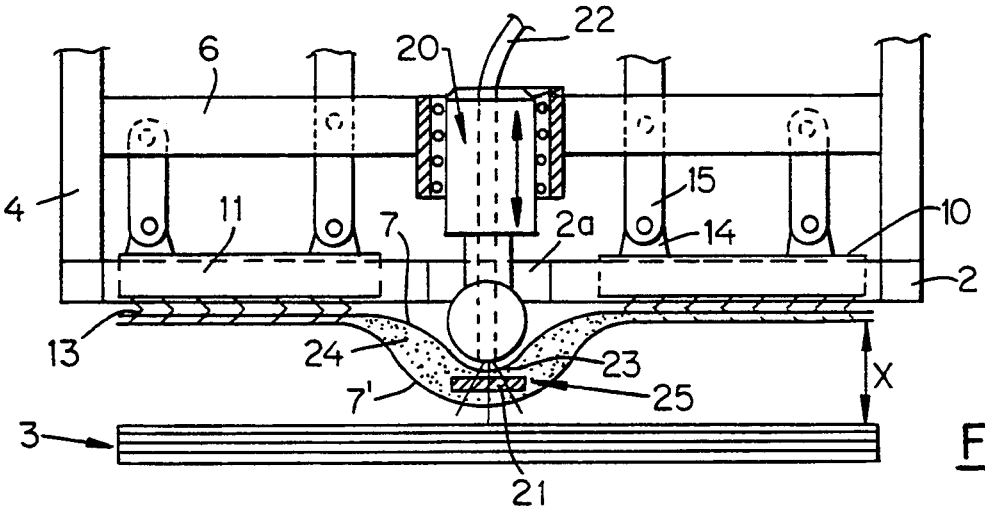
Figure 4:
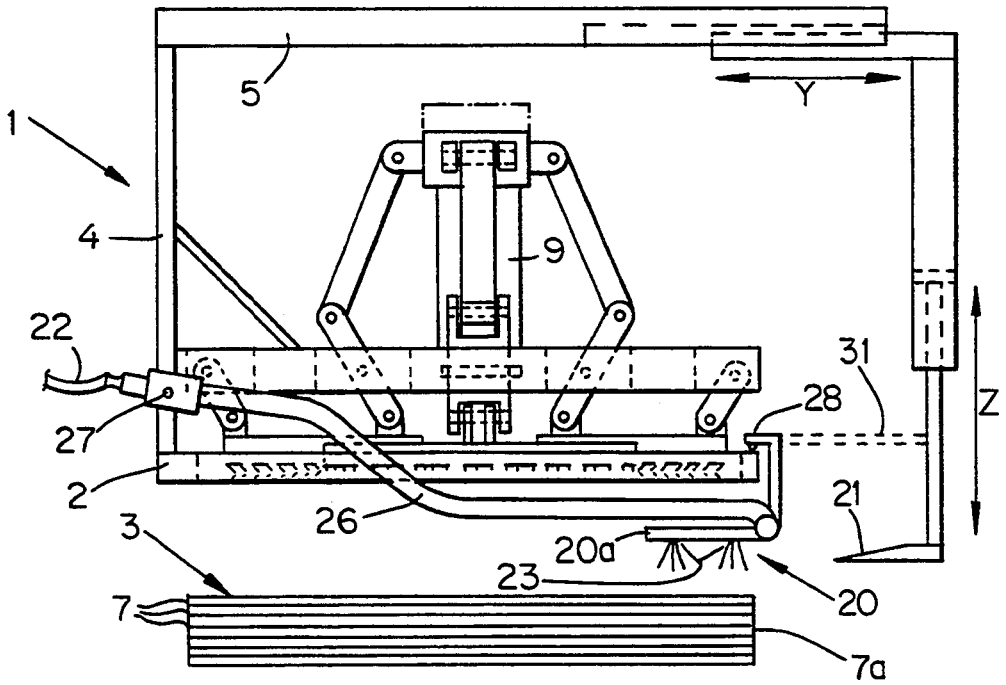
Figure 5:
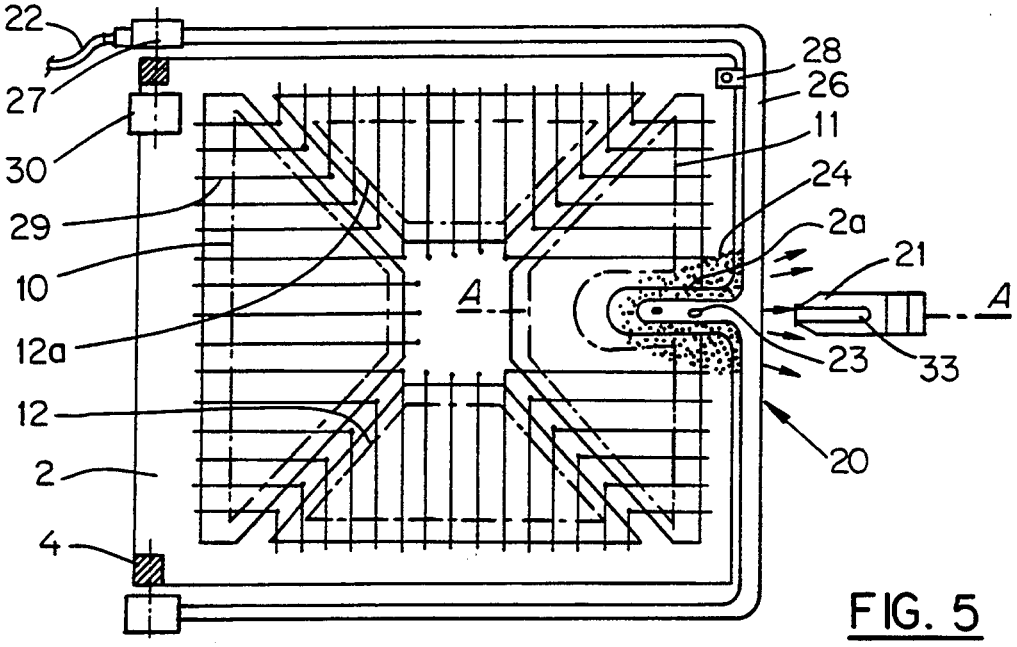
Figure 6:
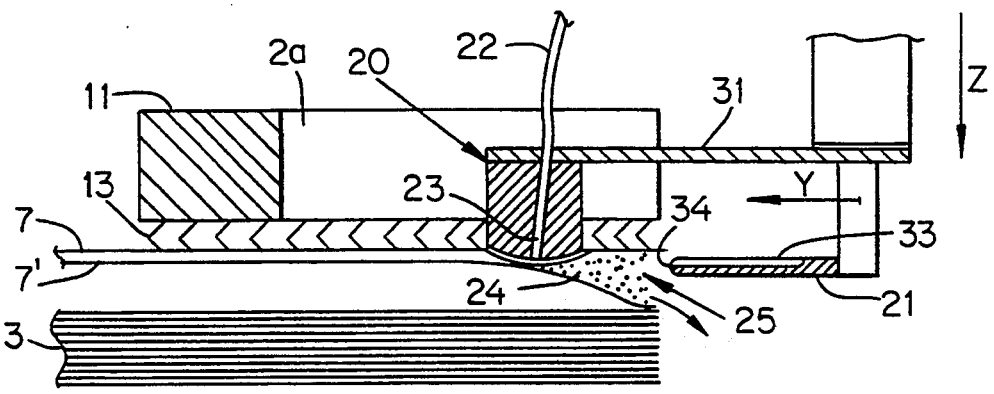

Further advantageous improvements are subjects of the subclaims and will be explained hereinafter by referring to two embodiments illustrated in the drawing. There are shown in:

FIG. 1 an elevational view of a gripping unit arranged above a pile of cuts;

FIG. 2 a perspectivic view of the gripping unit of FIG. 1;

FIG. 3 an enlarged illustration of the gripping unit having the uppermost cut gripped;

FIG. 4 a second embodiment of a gripping unit comprising a pivoting bale;

FIG. 5 a plan view of a gripping unit of FIG. 4;

FIG. 6 a sectional view along line A—A in FIG. 5.

FIGS. 1 and 2 illustrate the principal design of a gripping unit 1. The gripping unit 1 is placed with a base plate 2 on a pile 3 of similar cuts 7, still without engagement with the individual cuts. With this embodiment, the gripping unit 1 rests with its own weight on the pile 3 with support bars 8 engaging an upper frame portion 5 connected with base plate 2 by vertical support elements 4. The support bars 8 may be connected to a lifting structure or to a handling apparatus, as a robot. During lifting the support bars 8 the frame 5 and the whole gripping unit 1 are lifted as well. The design of the gripping unit 1 is explained in more detail in the non-prepublished DE-A-39 14 194 of the same applicant and is not essential for the present invention.

The cuts 7 of the pile 3 may be woven, knitted, or other textile cuts. The cuts 7, f. i. for articles of clothing, are sequentially lifted off by the gripping unit 1 by separating them from the pile 3. The support elements 4 are connected to each other by a support plate 6 in the center of which an actuating device 9 is provided for several gripping elements 10, 11, and 12, illustrated in detail in FIG. 2. The gripping elements 10, 11, and 12 may be spread apart in a horizontal plane in openings in the base plate 2, with hook-type needles 13 provided at the bottom side penetrating into the uppermost cut 7 of the pile 3.

For actuating the gripping unit 1 a plurality of eyelets 14 are provided at the top side of the gripping elements 10, 11, and 12, which eyelets are connected in a parallelogram-type manner by means of levers 15 to the base plate 6. The inner levers 15 are formed as two-arm levers and are connected each to a further pivoting lever 16 connected to a support head 17 of the actuating device 9. The actuating device 9 may exemplary be formed by a pneumatic cylinder which may be moved upward into the position shown in dot-dash lines upon actuation such that the pivoting levers 16 and the levers 15 are straightened, and thus the gripping elements 10, 11, and 12 are spread apart (see position in FIG. 3). Thus, the needles 13 prick outward and downward into the uppermost cut 7 of the pile 3. The depth of penetration of the needles 13 into the uppermost cut 7 may be adjusted by a different lifting-stroke of the actuating device 9. Upon engagement of the needles 13 the gripping unit 1 is lifted from the pile 3, for example by lifting the support bars 8, or is tilted away in upward direction such that at least the uppermost cut 7 is slightly lifted from the pile 3 by an amount x (see FIG. 3) and is conveyed after the blowing operation to further handling stations.

In FIG. 2 the gripping elements 10, 11, and 12 are illustrated in a perspectivic view. It may be gathered that upon actuation of the actuating cylinder 9 and the lever linkage 15, 16 connected thereto, the gripping elements 10, 11, and 12 are spread apart in a horizontal plane permitting the needles 13 to penetrate into the uppermost cut 7. However, it should be noted that this type of needle gripper may be replaced by an adhering gripper or a so-called freezing gripper or any other gripping device known to a skilled person.

Now, it is essential that in the region of at least one of the gripping elements a loading device 20 is provided, here indicated between the gripping elements 10 and 11. In this connection it is essential that the loading device 20 is arranged vertically freely movable in respect of the gripping elements 10 and 11 and may be lowered upon lifting by an amount x onto the surface of the gripped cut 7, independent from the height position of the gripping element 10, 11, and thus deforms or warps the cuts 7, 7'. Furthermore, it is essential that opposite the loading device 20 a holding-down element 21 is arranged (see also FIG. 4) which upon placement of the loading device 20 may be engaged below the uppermost gripped cut 7.

The operation step of placing the loading device 20 is illustrated in FIG. 3 with a view of the upper edge in FIG. 2, adjacent thereof is arranged the holding-down element 21, in a direction of arrow B. The gripping elements 10 and 11 are shown to have gripped the uppermost cut 7 with a further excessive cut 7' sticking thereto. The loading device 20, here in the form of a preferred blowing tube 20*a* connected to a pressurized air duct 22 is mounted on the support plate 6 (viz. FIG. 1) and is freely movable therein in vertical direction. Upon lifting the gripping unit 1 by an amount x of several centimeters upon gripping of at least one cut 7 the loading device 20 moves downward due to its own weight and loads the uppermost cut 7 such that it slightly sags in a pre-stressed condition, however still safely held by the needles of the gripping elements 10 and 11.

The pre-stress of the uppermost cut 7 may be increased by a spring-loaded loading device 20. Also, a pneumatic cylinder may be connected to the loading device 20 by arranging it in the support plate 6, which cylinder presses the loading device 20 with a defined force downward onto the cut 7. On the one hand, this results in a sagging downward of the cuts 7 and 7' and, therefore, in the causing of a shearing force between these two textile layers, which force causes a loosening and releasing of the adhesive forces in the region of the largest sagging, resulting in a slight gap 25. On the other hand, the uppermost cut 7 is always pressed into the same height position such that the downholder 21 may exactly enter from aside in this height position. Thus, the distance between the lower edge of the loading device 20, f. i. a simple flat bar, and the upper edge of the downholder 21 being exactly adjustable to the thickness of the fabrics (or a multiple thereof, f. i. for an intended gripping of two fabric layers each).

Loading device 20 is formed as a blowing tube 20*a* upon placement of which an air flow flows through the pressurized air duct 22 through the outlet opening 23 and through the uppermost cut 7 downward onto the further excessive cut 7'.

Since in contrast to the prior art the loading device 20 in the form of a blowing tube 20*a* in view of its own weight of the pre-stressing fixedly engages the cut 7 and is enclosed adjacent the outlet opening 23 from the uppermost cut 7 and is not apart therefrom, the supplied pressurized air is unable to exit outward between the gripping elements 10 and 11 and the uppermost cut 7. Rather, the pressurized air flows along the path of the least resistance which is in the region of the pressed-down and, therefore, warped cut 7. Thus, between the uppermost cut 7 and the excessive cut 7' an air cushion 24 illustrated in dotted lines is intentionally generated, resulting in a widening of the gap 25 between the uppermost cut 7 and the excessive cut 7', already caused by the placement, warping and sagging-down. This gap 25 is formed in a tunnel-type manner in view of the opposite arrangement of the loading device 20 in respect of the side edge provided adjacent to the downholder 21 (see FIG. 5, dotted region) such that the downholder 21 may safely enter the gap 25. Even if pressure application by the loading device 20 did not yet result in a complete separation of the excessive cut 7' now, the excessive cut 7' is retained by the downholder 21 on the residual pile 3 such that with the following further lifting of the gripping unit 1 only the uppermost cut 7 is conveyed away by the gripping elements 10, 11.

FIGS. 4 and 5 illustrate in an elevational view and a plan view a second embodiment of a gripping unit 1 comprising four gripping elements 10, 11, 12, and 12*a*. Instead of the translatorically movable loading device 20, here, it is mounted on a pivoting bale 26, freely movable in the vertical direction in the region of the gripping elements. The pivoting bale 26 houses the pressurized air duct 22 as well, guiding air to the tube-type loading device 20 supplied with pressurized air. The blowing tube 20*a* comprising the outlet openings 23 directed downward onto the pile 3 extends into a cut-out 2*a* in the base plate 2 and in the gripping element 10 and is freely vertically movable in this cut-out about a pivoting axis 27 of the pivoting bale 26 in a pivoting angle of about 10°. Upon placing the gripping elements onto the cut pile 3 the blowing tube 20*a* is located above the needles 13 and is then lowered during the lifting of the uppermost cut(s) 7, 7', or preferably shortly thereafter, by an amount x onto the surface of the uppermost cut 7, due to its own weight, until engagement of a stop 28 on the base plate 2. This results in the trough-type sagging of the cut(s) 7 illustrated in FIG. 3 and essential for the invention.

In FIG. 4 the lowest possible position of the blowing tube 20*a* is indicated, resulting in a sagging of several millimeters up to centimeters in respect of the major portion of the uppermost cut 7 sticking at the needles 13, dependent on the type of fabric, as illustrated in FIG. 3. In order to enforce the pre-stressing of the gripped uppermost cut 7 the pivoting bale 26 may be lowered by an actuating device, f. i. a pneumatic cylinder not shown in detail, up to the limit formed by the stop 28. Adjacent to the blowing tube 20*a* there is the downholder 21 which may be lowered in vertical direction, in accordance with the setting of the stop 28, up to a few millimeters below the lower edge of the blowing tube 20*a* and may engage from aside in horizontal direction Y into gap 25 shown in FIG. 3. The downholder 21 has a shape as flat as possible. It should be noted that even a single downholder 21 is sufficient for a safe operation, however, several downholders may be applied as well.

FIG. 5 shows in a plan view the cloverleaf-shaped arrangement of the gripping elements 10, 11, 12, and 12*a*, extending into correspondingly formed recesses in the base plate 12. At the edges of the recesses wires, f. i. piano cords 29 are indicated by horizontal and vertical lines for stripping off the gripped cut 7 upon withdrawal of the gripping elements, with the uppermost cut 7 being stripped off at the wires upon lifting of the gripping elements due to the lowering of the actuating cylinder 9 (see FIGS. 1 and 4). In the case that the pre-stressing of the uppermost cut 7 is accomplished by the own weight of the loading device 20 only, a rotation indicator 30 may be provided on the pivoting shaft 27 of the pivoting bale 26, which indicator determines the height position of the blowing tube 20*a*, depending on elasticity and, therefore, the amount of sagging (see FIG. 3) and controls the height position of the downholder 21 in Z direction. The height position of the upper edge of the downholder 21 corresponds to the lower edge of the blowing tube 20*a*, minor the actual thickness of the fabric of the cut 7 to be gripped, such that the downholder 21 may correspondingly be lifted or lowered, respectively, along the Z axis and will then be engaged in Y direction between the two uppermost cuts 7 and 7'.

Instead of detecting the Z position of the loading device 20 and the corresponding control of the downholder 21 (plus the actual thickness of the fabric) these two elements 20, 21 may be mounted independent from the gripper 1 on a common support 31 and may commonly be movable, as indicated in FIG. 4 in dashed lines and enlarged in FIG. 6. This results in maintaining a constant distance between the lower edge of the loading device 20 and the upper edge of the downholder 21 in Z direction, which distance is adjusted to the thickness of fabric currently processed.

FIG. 6 is a section along line A—A in FIG. 5, however with the loading device 20 having the form of a blowing tube 20*a* not mounted on the pivoting bale 26, but together with the downholder 21 on the support 31. Upon the illustrated placement (in Z direction) of the loading device 20 onto the uppermost gripped cut 7, warping and sagging of the cuts 7, 7', for spreading of the gap 25 pressurized air is actuated, flowing from the obliquely directed outlet opening 23 to the side edge. Now, the downholder 21 is laterally moved into the gap 25 along the Y axis, with the blowing tube 20*a* remaining in the shown position or, however, taken along in Y direction to the center of the gripper 1. With the last-mentioned alternative a tunnel-type shape of the air cushion 24 is achieved whose shaping may even be assisted by a further outlet opening 34 at the tip of the downholder 21. A similar effect will be achieved by a groove 33 at the top side of the downholder 21 illustrated in FIG. 5, through which groove the pressurized air flowing out of the outlet opening 23 is increasingly deflected inward upon the approach of the downholder 21 during its moving-in along the Y axis. These embodiments are particularly of use for separating cuts of large area.

We claim:

1. A method for separating an uppermost textile cut from a pile of textile cuts comprising the steps of:

gripping said uppermost cut at a top surface thereof;

lifting said uppermost cut;

imparting a load to a restricted area close to an edge of said uppermost cut, whereby said uppermost cut is sagged downward below a level at which said uppermost cut is gripped in a region of said restricted area, said sag causing a relative lateral movement between a said uppermost cut and further cuts possible clinging thereto;

blowing air from said top surface through said uppermost cut onto said further cuts, thus forming a tunnel-type gap therebetween; and moving a downholder laterally and translationally into said gap for completely separating said uppermost cut from said further cuts.

2. An apparatus for separating an uppermost textile cut from a pile of textile cuts comprising:

means for gripping and lifting said uppermost cut at a top surface thereof;

loading means mounted to be placed onto a restricted area close to an edge of said uppermost cut, for sagging said uppermost cut downward below a gripping level of said gripping means in a region of said restricted area, said sagging causing a relative lateral movement between said uppermost cut and further cuts possibly clinging thereto;

means for blowing air from said top surface through said uppermost cut onto said further cuts, thus forming a tunnel-type gap therebetween; and downholder means mounted to be moved laterally and translationally into said gap for completely separating said uppermost cut from said further cuts;

wherein said loading means is vertically movable relative to said gripping means below a gripping level of said gripping means onto said top surface of a gripped uppermost cut.

3. The apparatus of claim 2, wherein said loading means is spring-biased.

4. The apparatus of claim 2, wherein said loading means is connected to a piston/cylinder means for being lowered thereby up to a limiting stop.

5. The apparatus of claim 2, wherein said loading means is mounted telescopically movable onto said uppermost cut.

6. The apparatus of claim 2, wherein said loading means is mounted at a pivoting means for being moved into engagement with said uppermost cut.

7. The apparatus of claim 2, wherein said loading means in formed as a blowing tube having at least one nozzle directed toward said uppermost cut and connected to a pressurized air supply.

8. The apparatus of claim 2, further comprising a level sensor means detecting the height position of said loading means and means for adjusting a height position of said downholder means in dependence on the position detected by said level sensor means.

9. The apparatus of claim 2, wherein said Loading means and said downholder means are mounted on a common support vertically movable together, but independent from said gripping means such that a distance between a lower edge of said loading means and a upper edge of said downholder means is adjustable according to a thickness of textile cuts currently processed.

* * * * *

UNITED STATES PATENT AND TRADEMARK OFFICE

CERTIFICATE OF CORRECTION

PATENT NO. : 5,356,126

DATED : October 18, 1994

INVENTOR(S) : Fritz BAYER et al.

It is certified that error appears in the above-indentified patent and that said Letters Patent is hereby corrected as shown below:

On the title page, please delete item [73] and insert the following therefor:

--[73] Assignee: Institut für Textil- und Verfahrenstechnik der Deutschen Institute für Textil- und Faserforschung Stuttgart, Denkendorf, Fed. Rep. of Germany--.

Signed and Sealed this

Fourteenth Day of March, 1995

*Attest:*

*Attesting Officer*

Bruce Lehman

BRUCE LEHMAN

*Commissioner of Patents and Trademarks*